US011420252B2

(12) United States Patent
Dai et al.

(10) Patent No.: US 11,420,252 B2
(45) Date of Patent: Aug. 23, 2022

(54) PUNCH PIN ASSEMBLY AND DIE CASTING MACHINE HAVING PUNCH PIN ASSEMBLY

(71) Applicant: CITIC Dicastal CO., LTD., Hebei (CN)

(72) Inventors: Chuan Dai, Qinhuangdao (CN); Jiansheng Wang, Qinhuangdao (CN); Yachun Wan, Qinhuangdao (CN); Yang Han, Qinhuangdao (CN); Hongyin Zhang, Qinhuangdao (CN); Bo Tian, Qinhuangdao (CN); Gang Zhao, Qinhuangdao (CN); Zhi Chen, Qinhuangdao (CN)

(73) Assignee: CITIC DICASTAL CO., LTD., Hebei (CN)

( * ) Notice: Subject to any disclaimer, the term of this patent is extended or adjusted under 35 U.S.C. 154(b) by 6 days.

(21) Appl. No.: 16/712,074

(22) Filed: Dec. 12, 2019

(65) Prior Publication Data

US 2020/0206807 A1 Jul. 2, 2020

(30) Foreign Application Priority Data

Dec. 28, 2018 (CN) ..... 201811625692.3

(51) Int. Cl.
*B22D 17/20* (2006.01)

(52) U.S. Cl.
CPC ..... *B22D 17/203* (2013.01); *B22D 17/2038* (2013.01)

(58) Field of Classification Search
CPC ..... B22D 17/203; B22D 17/2038
See application file for complete search history.

(56) References Cited

U.S. PATENT DOCUMENTS 4,958,862 A * 9/1990 Cappelli ..... F16L 15/004 285/334
5,048,592 A * 9/1991 Mueller ..... B22D 17/203 164/312
2014/0123848 A1* 5/2014 Schivalocchi ..... F16J 1/08 92/153

FOREIGN PATENT DOCUMENTS

CN 104493126 B 4/2016
JP S63163252 U 10/1988
JP H0195858 A 4/1989
JP 2011092968 A 5/2011

OTHER PUBLICATIONS

Machine Translation of Dannoura (JP H01-095858A, Apr. 13, 1989, cited in IDS filed Jul. 21, 2020). (Year: 1989).*
Supplementary European Search Report in the European application No. 19196069.9, dated Apr. 20, 2020, 8 pgs.

* cited by examiner

*Primary Examiner* — Kevin E Yoon
*Assistant Examiner* — Jacky Yuen
(74) *Attorney, Agent, or Firm* — Cooper Legal Group, LLC

(57) ABSTRACT

A punch pin assembly includes a punch rod, a punch pin and a punch pin connection rod connected therebetween. A heat-conducting medium conveying loop is arranged in the punch rod and the punch pin connection rod. The heat-conducting medium conveying loop communicates with the outside of the punch rod separately through a first medium port and a second medium port which are formed in the punch rod.

7 Claims, 1 Drawing Sheet

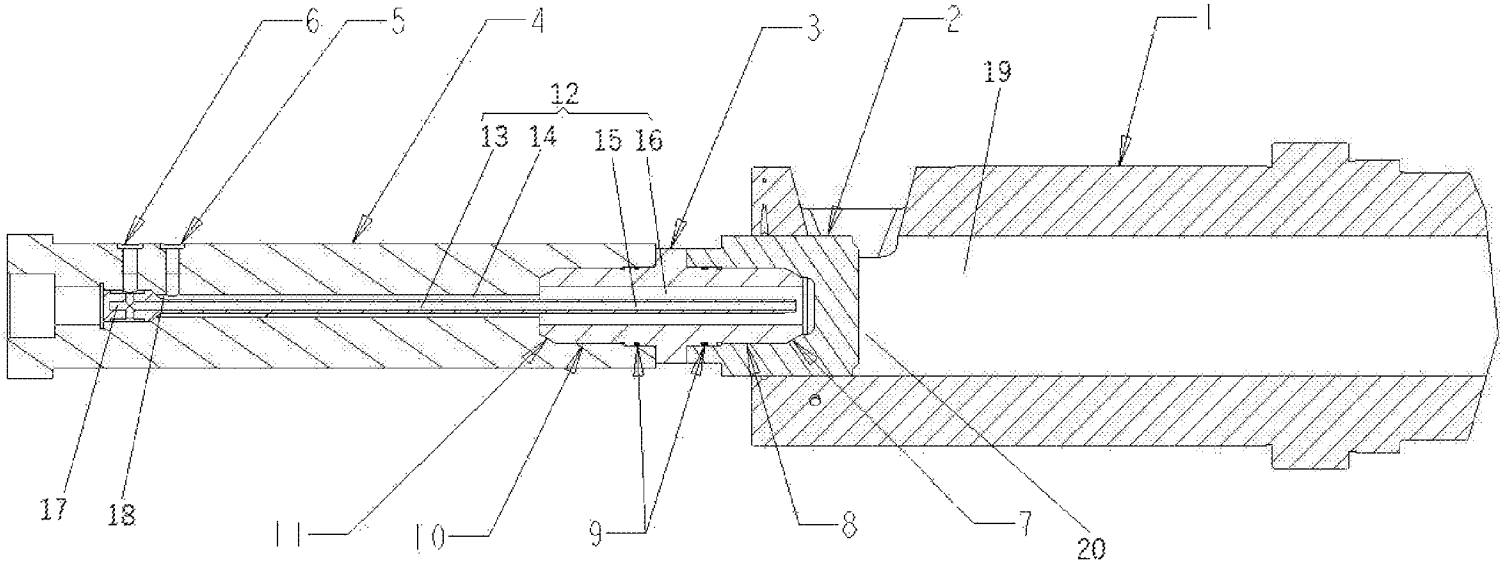
1
2
3
4
5
6
7
8
9
10
11
12
13
14
15
16
17
18
19
20

PUNCH PIN ASSEMBLY AND DIE CASTING MACHINE HAVING PUNCH PIN ASSEMBLY

CROSS-REFERENCE TO RELATED APPLICATION

The present application claims benefit of Chinese Patent Application No. 201811625692.3, filed on Dec. 28, 2018, the contents of which are hereby incorporated by reference in their entirety.

BACKGROUND

In high-pressure casting machining, a punch pin is operated at a high speed and high pressure in a reciprocating manner in a pressure chamber, and directly contacts die casting liquid (such as molten aluminum) in the pressure chamber, so that it is necessary to ensure good lubricating and cooling effects to ensure a steady die casting process and stable die casting quality. Generally, a heat-conducting medium such as low-temperature or normal-temperature water flows through the punch pin along a heat-conducting medium conveying loop and then returns to cool the punch pin. Specifically, heat transfer occurs between the heat-conducting medium at a position, close to the punch pin, in the heat-conducting medium conveying loop and the high-temperature punch pin, and then the heat-conducting medium is heated, and the punch pin is cooled. The heated heat-conducting medium flows out along the heat-conducting medium conveying loop. The heat-conducting medium continuously flows in the heat-conducting medium conveying loop to continuously cool the punch pin.

In the frequently high-speed and high-pressure operation, an existing sealed form is realized only by sealing rings between a punch pin connection rod and the punch pin as well as between the punch pin connection rod and a punch rod. It is inevitable that the sealing rings are aged and worn at a high temperature and high impact, which causes a poor sealing effect and the problem of water seepage from a connection position to the pressure chamber in a production process, thereby resulting in continuous mixing of circulating cooling water (or other heat-conducting mediums) into the die casting liquid. Water vapors formed by vaporization of the circulating cooling water under a high-temperature environment in the pressure chamber are drawn into the die casting liquid. If the sealing ring is not replaced, a produced casting would be prone to quality problems such as pores and low airtightness. If the sealing ring is replaced frequently, the machine will be shut down frequently, which affects the production efficiency.

Accordingly, there is a need for a punch pin assembly and a die casting machine having the punch pin assembly, which can solve or at least alleviate the above disadvantages in the prior art.

SUMMARY

The present disclosure relates to the field of die casting, and more particularly relates to a punch pin assembly and a die casting machine having the punch pin assembly.

In order to solve the technical problems, the present disclosure provides a punch pin assembly and a die casting machine having the punch pin assembly, which can guarantee a cooling effect on a punch pin and also improve the reliability of sealing between a punch pin connection rod and a punch rod as well as between the punch pin connection rod and the punch pin.

The technical solution adopted by the present disclosure is as follows.

The first aspect of the present disclosure provides a punch pin assembly. According to the first possible implementation of the first aspect of the present disclosure, the punch pin assembly includes:

a punch rod, herein the punch rod internally has a first heat-conducting medium conveying channel and a second heat-conducting medium conveying channel; the first heat-conducting medium conveying channel and the second heat-conducting medium conveying channel communicate with outside of the punch rod respectively through a first medium port and a second medium port which are formed in the punch rod;

a punch pin connection rod, herein the punch pin connection rod internally has an acting heat-conducting medium conveying channel; two ends of the acting heat-conducting medium conveying channel extend out of the punch pin connection rod and separately communicate with the first heat-conducting medium conveying channel and the second heat-conducting medium conveying channel to form a heat-conducting medium conveying loop; and a punch pin, herein the punch pin is connected to the punch rod through the punch pin connection rod;

at least one portion of the acting heat-conducting medium conveying channel is disposed in a way of achieving heat transfer with the punch pin;

the first medium port or the second medium port communicates with a low-temperature heat-conducting medium source to receive a heat-conducting medium for cooling the punch pin;

multiple sealing rings are mounted between the punch rod and the punch pin connection rod as well as between the punch pin connection rod and the punch pin, and multiple face seals are formed between the punch rod and the punch pin connection rod as well as between the punch pin connection rod and the punch pin.

According to a second possible implementation of the first aspect of the present disclosure, the punch rod may be a revolving body.

The first heat-conducting medium conveying channel may be of a cylindrical shape having an axis coinciding with the revolving center of the punch rod.

The second heat-conducting medium conveying channel may be of a barrel shape having an axis coinciding with the revolving center of the punch rod and a circular-ring cross section.

According to a third possible implementation of the first aspect of the present disclosure, the punch pin connection rod may be a revolving body. The acting heat-conducting medium conveying channel may include a third heat-conducting medium conveying channel and a fourth heat-conducting medium conveying channel.

The third heat-conducting medium conveying channel may be of a cylindrical shape having an axis coinciding with the revolving center of the punch pin connection rod.

The fourth heat-conducting medium conveying channel may be of a barrel shape having an axis coinciding with the revolving center of the punch pin connection rod and a circular-ring cross section.

An end, away from the first heat-conducting medium conveying channel, of the third heat-conducting medium conveying channel communicates with an end, away from the first heat-conducting medium conveying channel, of the fourth heat-conducting medium conveying channel.

According to a fourth possible implementation of the first aspect of the present disclosure, a containing slot may be formed in an end, adjacent to the punch pin connection rod, of the punch pin to contain an end, adjacent to the punch pin, of the punch pin connection rod.

According to a fifth possible implementation of the first aspect of the present disclosure, the punch rod may be connected to the punch pin connection rod through a thread; and/or the punch pin connection rod may be connected to the punch pin through a thread.

According to a sixth possible implementations of the first aspect of the present disclosure, the first medium port and the second medium port are disposed adjacent to each other at a first end of the punch rod. The first end of the punch rod is opposite to a second end of the punch rod. The punch pin connection rod is connected to the second end of the punch rod. The first medium port and the second medium port are disposed adjacent to each other at the first end of the punch rod, and the acting component is connected to the end opposite to the first end of the punch rod.

According to a seventh possible implementation of the first aspect of the present disclosure, a distance from the face seal between the punch rod and a punch pin connection rod to the first end of the punch rod may be shorter than a distance from a sealing ring between the punch rod and the punch pin connection rod to the first end of the punch rod; and/or a distance from the sealing ring between the punch pin connection rod and the punch pin to the first end of the punch rod may be shorter than a distance from the face seal between the punch pin connection rod and the punch pin to the first end of the punch rod.

According to an eighth possible implementation of the first aspect of the present disclosure, the first medium port may be disposed close to the first end of the punch rod, and the first heat-conducting medium conveying channel extends towards a direction close to the first end of the punch rod and goes beyond the first medium port to form a first buffer part; and/or the second heat-conducting medium conveying channel extends towards a direction close to the first end of the punch rod and goes beyond the second medium port to form a second buffer part.

The second aspect of the present disclosure provides a die casting machine. According to the first possible implementation of the second aspect of the present disclosure, the die casting machine includes a punch pin assembly according to the first to eighth possible implementations of the first aspect of the present disclosure; and a pressure chamber, herein the pressure chamber has a die casting cavity and a punch pin hole for allowing the punch pin to pass through. The die casting cavity communicates with the outside of the pressure chamber through the punch pin hole.

According to one or more implementations of the present disclosure, the following beneficial effects can be achieved:

a low-temperature heat-conducting medium flows from the first medium port or the second medium port into the first heat-conducting medium conveying channel or the second heat-conducting medium conveying channel, and then flows along the heat-conducting medium conveying loop; when flowing to a position favorable for heat transfer with the punch pin, the low-temperature heat-conducting medium exchanges heat with the punch pin, so that the punch pin is effectively cooled, thereby ensuring a steady die casting process and stable die casting quality;

the sealing rings are mounted and face seals are formed between the punch rod and the punch pin connection rod as well as between the punch pin connection rod and the punch pin, so that the dual sealing of the sealing rings and the face seals guarantees the sealing effect; and even if the sealing effect of the sealing rings becomes poor, the face seals may still ensure the sealing between the punch rod and the punch pin connection rod as well as between the punch pin connection rod and the punch pin, prevent quality problems of pores, low airtightness and the like of a produced casting due to the fact that a heat-conducting medium (such as water) in the heat-conducting medium conveying loop leaks out and enters the pressure chamber, and avoid frequent shutdown caused by frequent replacement of the sealing rings and influence on the production efficiency.

BRIEF DESCRIPTION OF THE DRAWINGS

The technical and industrial meanings of the features, advantages and exemplary implementations of the present disclosure will be described below with reference to accompanying drawings. In the drawings, the same numerals refer to same elements.

FIG. 1 is an axial cross-sectional view of a punch pin assembly according to an exemplary implementation of the present disclosure, herein a pressure chamber is shown.

DETAILED DESCRIPTION OF THE EMBODIMENTS

The exemplary implementation of the present disclosure is described below in detail with reference to the drawing. The descriptions of the exemplary implementation are merely illustrative, and shall in no way limit the present disclosure and its application or usage. Furthermore, the sizes and proportions of all components in the drawings are also merely illustrative, and do not really correspond to actual products.

FIG. 1 is an axial cross-sectional view of a punch pin assembly according to an exemplary implementation of the present disclosure, herein a pressure chamber 1 is shown. As shown in FIG. 1, the punch pin assembly includes a punch rod 4, a punch pin 2 and a punch pin connection rod 3 connected therebetween. Multiple sealing rings 9 are mounted between the punch rod 4 and the punch pin connection rod 3 as well as between the punch pin connection rod 3 and the punch pin 2, and multiple face seals (respectively a face seal 11 and a face seal 7) are formed between the punch rod 4 and the punch pin connection rod 3 as well as between the punch pin connection rod 3 and the punch pin 2. The punch rod 4 and the punch pin connection rod 3 are of hollow structures. That is, they internally have a heat-conducting medium conveying loop 12. At least one portion of an acting heat-conducting medium conveying channel (the at least one portion in FIG. 1 is a portion, close to the punch pin, of the acting heat-conducting medium conveying channel) may be disposed in a way of achieving heat transfer with the punch pin 2. The heat-conducting medium conveying loop 12 is filled with a heat-conducting medium such as low-temperature (less than the temperature of the punch pin) water. The heat-conducting medium flows along the heat-conducting medium conveying loop 12, so as to realize heat transfer with the punch pin 2 to cool the punch pin 2. The dual action of the sealing rings 9 and the face seals 11 and 7 ensures the reliability of sealing between the punch rod 4 and the punch pin connection rod 3 as well as between the punch pin connection rod 3 and the punch pin 2.

A specific arrangement solution of the heat-conducting medium conveying loop 12 is as follows: the punch rod 4 internally has a first heat-conducting medium conveying channel 13 and a second heat-conducting medium conveying channel 14; the first heat-conducting medium conveying channel 13 and the second heat-conducting medium conveying channel 14 communicate with the outside of the punch rod 4 respectively through a first medium port 6 and a second medium port 5 which are formed in the punch rod 4;

the punch pin connection rod 3 internally has the acting heat-conducting medium conveying channel; two ends of the acting heat-conducting medium conveying channel extend out of the punch pin connection rod 3 and respectively communicate with the first heat-conducting medium conveying channel 13 and the second heat-conducting medium conveying channel 14 to form the heat-conducting medium conveying loop 12.

Any one of the first medium port 6 or the second medium port 5 may communicate with a low-temperature heat-conducting medium source to receive a heat-conducting medium. Under the condition that the first medium port 6 communicates with the heat-conducting medium source, the flowing direction of the heat-conducting medium in the heat-conducting medium conveying loop 12 is: the first medium port 6 to the first heat-conducting medium conveying channel 13 to a third heat-conducting medium conveying channel 15 to a fourth heat-conducting medium conveying channel 16 to the second heat-conducting medium conveying channel 14 to the second medium port 5. Under the condition that the second medium port 5 communicates with the heat-conducting medium source, the flowing direction of the heat-conducting medium in the heat-conducting medium conveying loop 12 is: the second medium port 5, the second heat-conducting medium conveying channel 14, the fourth heat-conducting medium conveying channel 16, the third heat-conducting medium conveying channel 15, the first heat-conducting medium conveying channel 13, and the first medium port 6.

It should be noted that the heat-conducting medium is water since the water is high in specific heat capacity, wide in source and low in usage cost. Correspondingly, the heat-conducting medium source may be a water supply pipe network (such as a tap water pipe network), and may also be a container such as a tank capable of holding water according to an actual requirement.

A specific structure of the punch rod 4 is as follows: the punch rod 4 is a revolving body; the first heat-conducting medium conveying channel 13 is of a cylindrical shape having an axis coinciding with the revolving center of the punch rod 4; and the second heat-conducting medium conveying channel is of a barrel shape having an axis coinciding with the revolving center of the punch rod 4 and having a circular-ring cross section. Of course, the punch rod 4 may be of a non-revolving structure such as a prism, the cross section of the first heat-conducting medium conveying channel 13 may be of a special shape, and the cross section of the second heat-conducting medium conveying channel 14 may be of a specially-shaped ring, as long as they are configured according to an actual requirement.

A specific structure of the punch pin connection rod 3 is as follows: the punch pin connection rod 3 is a revolving body. The acting heat-conducting medium conveying channel includes the third heat-conducting medium conveying channel 15 and the fourth heat-conducting medium conveying channel 16. The third heat-conducting medium conveying channel 15 may be of a cylindrical shape having an axis coinciding with the revolving center of the punch pin connection rod 3, and the fourth heat-conducting medium conveying channel 16 may be of a barrel shape having an axis coinciding with the revolving center of the punch pin connection rod 3 and a circular-ring-shaped cross section. The configuration is the same as that of the punch rod 4, and no more repeated descriptions will be provided.

The end, away from the first heat-conducting medium conveying channel 13, of the third heat-conducting medium conveying channel 15 communicates with the end, away from the first heat-conducting medium conveying channel 13, of the fourth heat-conducting medium conveying channel 16. This configuration makes the acting heat-conducting medium conveying channel basically twice as long as the punch pin connection rod 3, so that the internal space of the punch pin connection rod 3 is fully used. On the premise that the cross-sectional area of a heat-conducting medium conveying pipeline is constant, the punch pin connection rod 3 with a relatively small size may hold a sufficient amount of heat-conducting medium, thereby ensuring the cooling capacity of the punch pin assembly.

In addition, a containing slot is formed in the end, adjacent to the punch pin connection rod 3, of the punch pin 2, and the end of the punch pin connection rod 3 adjacent to the punch pin 2 is held in the containing slot. On one hand, the containing slot plays a locating role during assembling of the punch pin connection rod 3 and the punch pin 2; and on the other hand, the side wall of the containing slot forms an inward restriction to the punch pin connection rod 3 in a lateral direction, so as to enhance the lateral connection strength between the punch pin connection rod 3 and the punch pin 2 and prolong the service life of the punch pin assembly. It should be noted that the punch rod 4 is connected to the punch pin connection rod 3 through a thread 10; and/or, the punch pin connection rod 3 is connected to the punch pin 2 through a thread 8. By the adoption of the threads 10 and 8 for connection, the installation and removal are convenient, and the punch pin assembly is convenient to repair and maintain (debris in the heat-conducting medium conveying loop 12 can be cleared conveniently).

The first medium port 6 and the second medium port 5 are disposed adjacent to each other at the first end of the punch rod 4. The first end of the punch rod 4 is opposite to the second end of the punch rod 4. The punch pin connection rod 3 is connected to the second end of the punch rod 4. This configuration makes the first heat-conducting medium conveying channel 13 and the second heat-conducting medium conveying channel 14 rightwards (in FIG. 1, the right direction is right, and the left direction is left) completely extend to the second end of the punch rod 4. On the premise that the cross-sectional area of a heat-conducting medium conveying pipeline is constant, the punch rod 4 with a relatively small size may hold a sufficient amount of heat-conducting medium, thereby ensuring the cooling capacity of the punch pin assembly.

It should be noted that a distance from the face seal between the punch rod 4 and the punch pin connection rod 3 to the first end of the punch rod 4 is shorter than a distance from the sealing ring 9 between the punch rod 4 and the punch pin connection rod 3 to the first end of the punch rod 4. This configuration makes the face seal 11 to be closer to the first end of the punch rod 4 than the sealing ring 9. That is, the face seal 11 is closer to the second heat-conducting medium conveying channel 14. When leakage occurs at a certain position of the second heat-conducting medium conveying channel 14, the leaking heat-conducting medium may only flow to the face seal 11, and would not continue to flow towards the sealing ring 9 under the sealing action of the face seal 11, so that the leaking amount (equal to the volume of a space jointly defined by the leaking position of the second heat-conducting medium conveying channel 14, the face seal 11, the punch pin connection rod 3 and the punch rod 4) is relatively small. The heat-conducting medium at the relatively small leaking amount is extremely low in flowability, and even does not flow, thereby ensuring a relatively small amount of heat-conducting medium which flows little and even does not flow and improving the cooling capacity of the punch pin assembly to cool the punch pin 2 more effectively.

Similarly, a distance from the sealing ring 9 between the punch pin connection rod 3 and the punch pin 2 to the first end of the punch rod 4 is shorter than a distance from the face seal 7 between the punch pin connection rod 3 and the punch pin 2 to the first end of the punch rod 4. The cooling capacity of the punch pin assembly is further improved, and the punch pin 2 is cooled more effectively.

In addition, the first medium port 6 is disposed close to the first end of the punch rod 4, and the first heat-conducting medium conveying channel 13 extends towards a direction close to the first end of the punch rod 4 and goes beyond the first medium port 6 to form a first buffer part 17. By the arrangement of the first buffer part 17, the heat-conducting medium flows more steadily and slowly between the first medium port 6 and the first heat-conducting medium conveying channel 13, so as to avoid the influence on the sealing properties of the sealing ring 9 and the face seal 11 due to excessive impact on the first medium port 6 and the first heat-conducting medium conveying channel 13 during flowing of the heat-conducting medium and to further improve the sealing property of the punch pin assembly.

Similarly, the second heat-conducting medium conveying channel 14 extends towards a direction close to the first end of the punch rod 4 and goes beyond the second medium port 5 to form a second buffer part 18. The sealing property of the punch pin assembly is further improved.

As shown in FIG. 1, the first medium port 6 communicates with the heat-conducting medium source, and the punch pin 2 is cooled by the flowing of the heat-conducting medium source in the heat-conducting medium conveying loop 12. The low-temperature heat-conducting medium source flows along the first heat-conducting medium conveying channel 13 and the third heat-conducting medium conveying channel 15 in the middle, and then is heated by heat absorption at a portion, close to the punch pin 2, on the third heat-conducting medium conveying channel 15. Then, the heated heat-conducting medium source returns along the fourth heat-conducting medium conveying channel 16 and the second heat-conducting medium conveying channel 14 on the outer side. In case that the heat-conducting medium in the heat-conducting medium conveying loop 12 is in a horizontal state: when the liquid level of the heat-conducting medium in the second heat-conducting medium conveying channel 14 and the fourth heat-conducting medium conveying channel 16 is lower than the liquid level of the heat-conducting medium in the first heat-conducting medium conveying channel 13 and the third heat-conducting medium conveying channel 15, the low-temperature heat-conducting medium which is not heated flows along the first heat-conducting medium conveying channel 13 and the third heat-conducting medium conveying channel 15 without resistance (the influence of the internal viscous resistance of the heat-conducting medium is neglected), which accelerates the flowing of the heat-conducting medium and further improves the cooling capacity of the punch pin assembly.

The present disclosure further discloses a die casting machine. The die casting machine includes a pressure chamber 1 and any possible embodiments of the above punch pin assembly. The pressure chamber 1 has a die casting cavity 19 and a punch pin hole 20 for allowing the punch pin to pass through. The die casting cavity 19 communicates with the outside of the pressure chamber 1 through the punch pin hole 20. The punch pin 2 moves in a reciprocating manner along the punch pin hole 20, so as to complete die casting work.

The implementations of the present disclosure above are described in detail. However, the aspects of the present disclosure are not limited to the above implementations. Various modifications and replacements can be all applied to the above implementations without departing from the scope of the present disclosure.

The invention claimed is:

1. A punch pin assembly, comprising:

a punch rod, the punch rod internally having a first heat-conducting medium conveying channel and a second heat-conducting medium conveying channel; the first heat-conducting medium conveying channel and the second heat-conducting medium conveying channel communicating with outside of the punch rod respectively through a first medium port and a second medium port which are formed in the punch rod;

a punch pin connection rod, the punch pin connection rod internally having an acting heat-conducting medium conveying channel; two ends of the acting heat-conducting medium conveying channel extending out of the punch pin connection rod and communicating with the first heat-conducting medium conveying channel and the second heat-conducting medium conveying channel respectively to form a heat-conducting medium conveying loop, wherein the acting heat-conducting medium conveying channel comprises a third heat-conducting medium conveying channel and a fourth heat-conducting medium conveying channel, and the third heat-conducting medium conveying channel directly communicates with the fourth heat-conducting medium conveying channel at an end, away from the punch rod, of the punch pin connection rod; and a punch pin, the punch pin connected to the punch rod through the punch pin connection rod, wherein:

at least one portion of the acting heat-conducting medium conveying channel is disposed in a way of achieving heat transfer with the punch pin;

the first medium port or the second medium port communicates with a low-temperature heat-conducting medium source to receive a heat-conducting medium for cooling the punch pin;

a plurality of sealing rings are mounted between the punch rod and the punch pin connection rod as well as between the punch pin connection rod and the punch pin, a plurality of face seals are formed between the punch rod and the punch pin connection rod as well as between the punch pin connection rod and the punch pin, and each of the plurality of face seals includes a beveled surface; and the first medium port and the second medium port are arranged at a first end of the punch rod in an adjacent manner, the first end of the punch rod is opposite to a second end of the punch rod, and the punch pin connection rod is connected to the second end of the punch rod, wherein at least one of:

a distance from a face seal of the plurality of face seals between the punch rod and the punch pin connection rod to the first end of the punch rod is shorter than a distance from a sealing ring of the plurality of sealing rings between the punch rod and the punch pin connection rod to the first end of the punch rod; or a distance from a sealing ring of the plurality of sealing rings between the punch pin connection rod and the punch pin to the first end of the punch rod is shorter than a distance from a face seal of the plurality of face seals between the punch pin connection rod and the punch pin to the first end of the punch rod.

2. The punch pin assembly according to claim 1, wherein the punch rod is a revolving body;

the first heat-conducting medium conveying channel is of a cylindrical shape having an axis coinciding with a revolving center of the punch rod; and the second heat-conducting medium conveying channel is of a barrel shape having an axis coinciding with the revolving center of the punch rod and having a circular-ring cross section.

3. The punch pin assembly according to claim 2, wherein the punch pin connection rod is a revolving body;

the third heat-conducting medium conveying channel is of a cylindrical shape having an axis coinciding with a revolving center of the punch pin connection rod;

the fourth heat-conducting medium conveying channel is of a barrel shape having an axis coinciding with the revolving center of the punch pin connection rod and having a circular-ring cross section; and an end, away from the first heat-conducting medium conveying channel, of the third heat-conducting medium conveying channel communicates with an end, away from the first heat-conducting medium conveying channel, of the fourth heat-conducting medium conveying channel.

4. The punch pin assembly according to claim 1, wherein a containing slot is formed in an end, adjacent to the punch pin connection rod, of the punch pin to hold an end, adjacent to the punch pin, of the punch pin connection rod.

5. The punch pin assembly according to claim 1, wherein at least one of:

the punch rod is connected to the punch pin connection rod through a thread; or the punch pin connection rod is connected to the punch pin through a thread.

6. The punch pin assembly according to claim 1, wherein:

the first medium port is disposed close to the first end of the punch rod, and at least one of:

the first heat-conducting medium conveying channel extends towards a direction close to the first end of the punch rod and goes beyond the first medium port to form a first buffer part; or the second heat-conducting medium conveying channel extends towards a direction close to the first end of the punch rod and goes beyond the second medium port to form a second buffer part.

7. A die casting machine, comprising a punch pin assembly and a pressure chamber, wherein:

the punch pin assembly comprises:

a punch rod, the punch rod internally having a first heat-conducting medium conveying channel and a second heat-conducting medium conveying channel; the first heat-conducting medium conveying channel and the second heat-conducting medium conveying channel communicating with outside of the punch rod respectively through a first medium port and a second medium port which are formed in the punch rod;

a punch pin connection rod, the punch pin connection rod internally having an acting heat-conducting medium conveying channel; two ends of the acting heat-conducting medium conveying channel extending out of the punch pin connection rod and communicating with the first heat-conducting medium conveying channel and the second heat-conducting medium conveying channel respectively to form a heat-conducting medium conveying loop, wherein the acting heat-conducting medium conveying channel comprises a third heat-conducting medium conveying channel and a fourth heat-conducting medium conveying channel, and the third heat-conducting medium conveying channel directly communicates with the fourth heat-conducting medium conveying channel at an end, away from the punch rod, of the punch pin connection rod; and a punch pin, the punch pin connected to the punch rod through the punch pin connection rod, wherein:

at least one portion of the acting heat-conducting medium conveying channel is disposed in a way of achieving heat transfer with the punch pin;

the first medium port or the second medium port communicates with a low-temperature heat-conducting medium source to receive a heat-conducting medium for cooling the punch pin;

a plurality of sealing rings are mounted between the punch rod and the punch pin connection rod as well as between the punch pin connection rod and the punch pin, a plurality of face seals are formed between the punch rod and the punch pin connection rod as well as between the punch pin connection rod and the punch pin, and each of the plurality of face seals includes a beveled surface; and the first medium port and the second medium port are arranged at a first end of the punch rod in an adjacent manner, the first end of the punch rod is opposite to a second end of the punch rod, and the punch pin connection rod is connected to the second end of the punch rod, wherein at least one of:

a distance from a face seal of the plurality of face seals between the punch rod and the punch pin connection rod to the first end of the punch rod is shorter than a distance from a sealing ring of the plurality of sealing rings between the punch rod and the punch pin connection rod to the first end of the punch rod; or a distance from a sealing ring of the plurality of sealing rings between the punch pin connection rod and the punch pin to the first end of the punch rod is shorter than a distance from a face seal of the plurality of face seals between the punch pin connection rod and the punch pin to the first end of the punch rod; and the pressure chamber has a die casting cavity and a punch pin hole for allowing the punch pin to pass through, and the die casting cavity communicates with outside of the pressure chamber through the punch pin hole.

* * * * *